US006880185B1

(12) United States Patent
McAdams

(10) Patent No.: US 6,880,185 B1
(45) Date of Patent: Apr. 19, 2005

(54) CONVERTIBLE LOFT FURNITURE

(76) Inventor: Dennis K. McAdams, 24 Isbel St., Apt. 296, Binghamton, NY (US) 13901

( * ) Notice: Subject to any disclaimer, the term of this patent is extended or adjusted under 35 U.S.C. 154(b) by 78 days.

(21) Appl. No.: 10/120,311

(22) Filed: Apr. 10, 2002

(51) Int. Cl.[7] ..... A47B 85/00
(52) U.S. Cl. ..... 5/2.1; 5/10.1
(58) Field of Search ..... 5/2.1, 110.1

(56) References Cited

U.S. PATENT DOCUMENTS 3,755,831 A * 9/1973 Bergmann ..... 5/2.1
4,236,460 A * 12/1980 Poupko ..... 108/41
5,101,523 A * 4/1992 Bright ..... 5/2.1
5,522,097 A * 6/1996 Ciccotelli ..... 5/2.1
5,601,348 A * 2/1997 Minkovski ..... 5/133
5,713,650 A * 2/1998 King et al. ..... 5/2.1
5,754,995 A * 5/1998 Behrendt ..... 5/9.1
5,765,239 A * 6/1998 Moses ..... 5/2.1
5,842,586 A * 12/1998 Melby ..... 5/10.1
6,167,579 B1 * 1/2001 Kopish ..... 5/2.1
6,401,276 B1 * 6/2002 Sherman ..... 5/2.1
6,508,526 B1 * 1/2003 Reppas et al. ..... 312/237
6,568,001 B1 * 5/2003 Walsh ..... 5/2.1

FOREIGN PATENT DOCUMENTS

FR 2652250 * 3/1991 ..... 5/2.1

* cited by examiner

*Primary Examiner*—Frederick L. Lagman
(74) *Attorney, Agent, or Firm*—Mark Levy & Associates; David L. Banner

(57) ABSTRACT

A versatile furniture unit that is easily changed, or modified to meet different living settings. The furniture unit is constructed as a frame that can be hung from the joists or rafters in a loft ceiling. The frame comprises various furniture elements that can be added on, folded up, or folded down to provide a different living appearance depending on the time of day. The furniture unit easily converts from a living room or playroom setting during the day to a bedroom setting for nighttime.

20 Claims, 5 Drawing Sheets

CONVERTIBLE LOFT FURNITURE

FIELD OF THE INVENTION

This invention relates to loft furniture and, more particularly, to loft furniture that can be converted into a plurality of different living configurations befitting the needs of the loft inhabitant.

BACKGROUND OF THE INVENTION

It is difficult to furnish a loft with furniture. Often one finds the loft area is oddly shaped and limited by overhangs, sloping ceilings, and other odd ceiling and wall configurations. Providing furniture for these unusually shaped areas and making full use of the available space can present a challenge.

Loft areas are usually filled with convertible beds and fold-up desks because of the limited space. Despite the ingenuity of loft inhabitants, most loft furniture arrangements appear to be awkward and haphazardly put together. These arrangements often lack functionality and aesthetic considerations.

The present invention has determined that furnishing a loft could be made much simpler if the loft inhabitant could purchase a single, versatile furniture unit that could be rearranged in an infinite number of ways.

The current invention comprises a single furniture unit that can be hung from the joists or rafters of the loft ceiling. The furniture unit has a frame that can support various furniture items such as a bed, lounge chair, book shelves, cabinets, cubbyholes, chests, benches, desks, a drinking bar, etc. The furniture unit does not carry all of these furniture items at one time, but rather has the means to add items or convert its space to include combinations of elements. Various elements can be folded away, folded down, or tucked inside. For example, a lounge chair or couch can be folded down to become a bed. Shelves can be spaced to suit the area needed for a library. Cabinets can be dropped into place. The user of this invention can give the furniture unit a new look or functionality as often as befits his needs, his aesthetics, and the available space.

The single furniture unit of this invention provides an assembly that can be rearranged, assembled, disassembled, and modified to accommodate the space within a loft.

The loft furniture unit of the invention has the versatility to easily convert the furniture from daytime living to nighttime living.

SUMMARY OF THE INVENTION

In accordance with the current invention, a furniture unit for a loft that can be modified, assembled, and disassembled with various furniture elements to provide different living arrangements is presented. The furniture unit comprises a frame that can be attached to the ceiling rafters or joists of the loft. The frame has attachments and peg holes for adding furniture elements, fold-up and fold-down units for rearranging existing furniture elements about the frame, and conversion-type elements such as a bed that converts to a couch and vice versa. The versatility of the furniture unit allows the user to provide different living settings such as a living room setting, a bedroom setting, a playroom setting, etc. The versatility of this furniture unit also allows for ease of change, such as converting a daytime living room or playroom setting to a bedroom setting for nighttime in just a few minutes.

It is an object of this invention to provide improved loft furniture.

It is another object of the invention to provide a single furniture unit for a loft that can be easily converted from daytime to nighttime living.

BRIEF DESCRIPTION OF THE DRAWINGS

A complete understanding of the present invention may be obtained by reference to the accompanying drawings when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, the invention features a versatile furniture unit that is easily changed or modified to meet different living settings. The furniture unit is constructed as a frame that can be hung from the joists in a loft. The frame comprises various furniture elements that can be added on, folded up, or folded down to provide a different living appearance depending on the time of day. The furniture unit easily converts from a living room or playroom setting during the day to a bedroom setting for nighttime.

Figure 1:
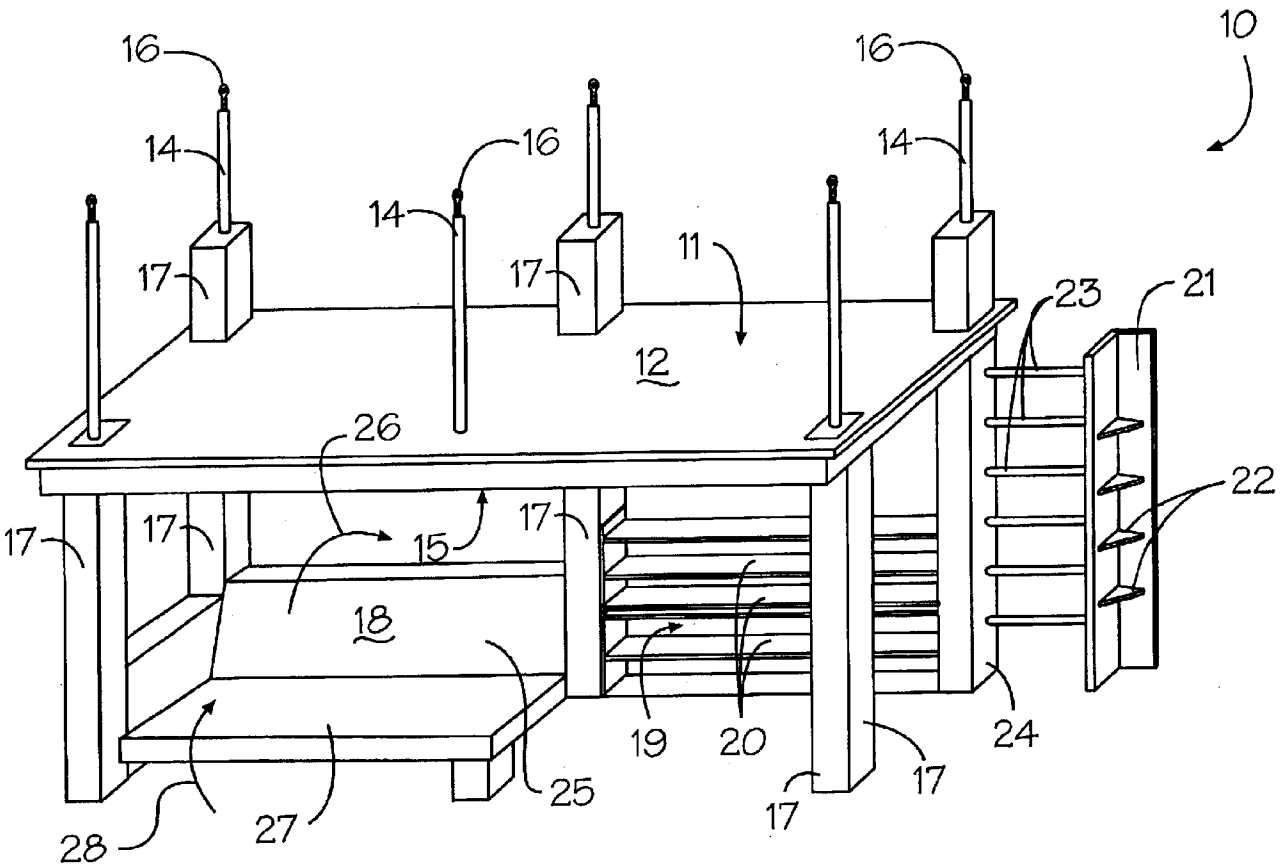
FIG. 1 illustrates a perspective view of the loft furniture unit of this invention.

Now referring to FIG. 1, the loft furniture unit 10 of this invention is shown. The loft furniture unit 10 comprises a frame 11 having a platform 12 on which various furniture elements can be attached. The frame 11 can be anchored to the rafters or joists (not shown) of the ceiling of the loft by means of stringers 14. The stringers 14 have loopholes 16 for receiving bolts for attachment to the joists. The platform 12 of the frame 11 can be fitted with cubbyholes 15 for storing additional furniture elements like shelves for storing out of season clothing or various knickknacks to place on the shelves. The frame 11 can also be attached to the walls of the loft by hanger elements (not shown here).

The frame 11 has several columns 17 providing support for the furniture disposed on the frame 11. The current furniture setting for the unit shown here in FIG. 1 is for a living room. The living room setting comprises a couch 18 and an adjacent library unit 19 comprising a number of shelves 20. The back 25 of the couch 18 can be folded down (arrow 26) to become a bed for nighttime living. A decorative shelf 21 is attachable to the right-hand wall 24 of the library unit 19 via decorative rods 23. The decorative shelf 21 comprises triangular shelves 22 for placement of plants, statues, or other items of aesthetic quality.

Figure 2:
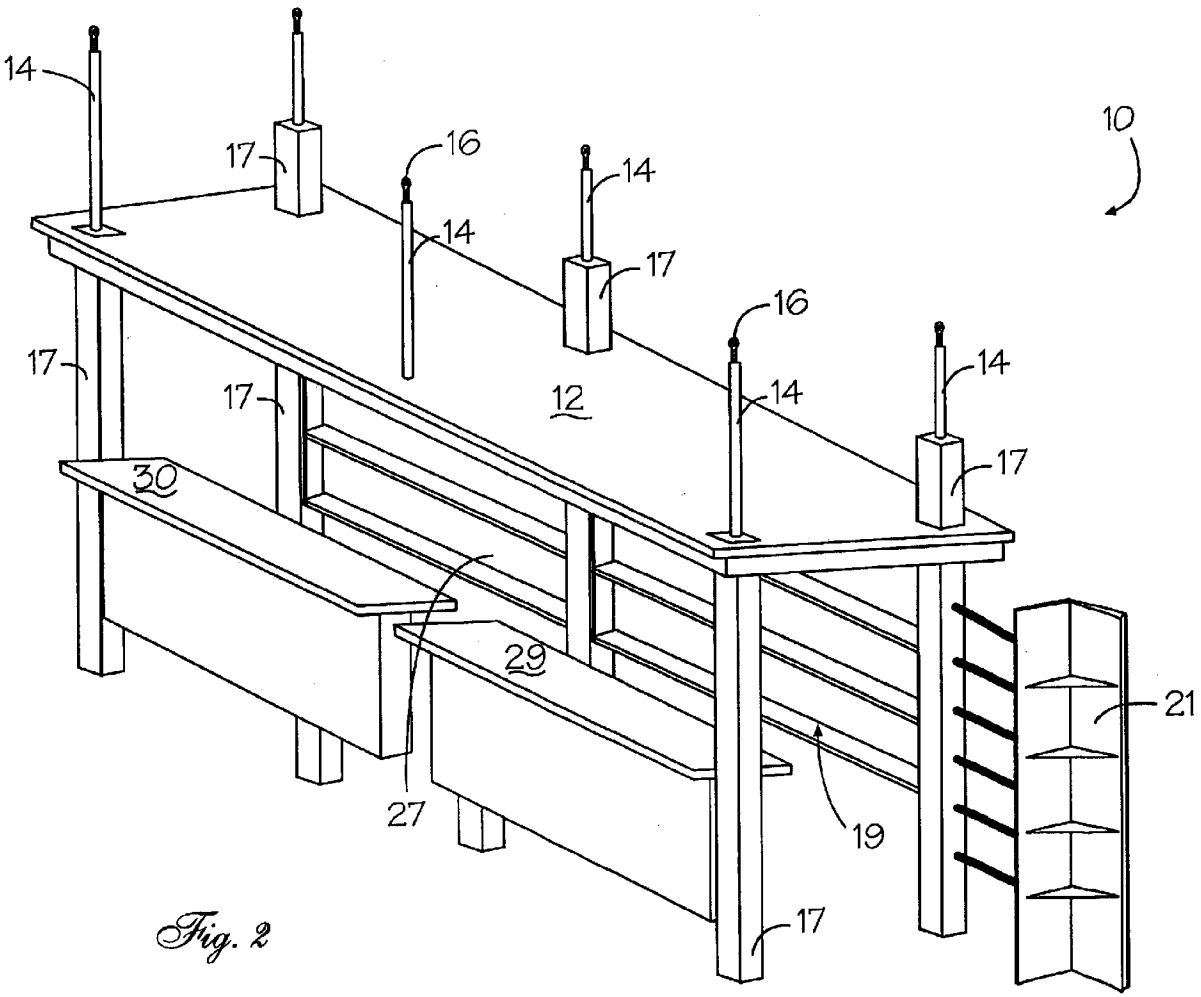
FIG. 2 depicts a perspective view of the loft furniture unit that is shown in FIG. 1, but with a modified appearance.

Referring to FIG. 2, the furniture unit 10 is shown with a playroom setting. In order to modify the living room setting shown in FIG. 1, the front portion 27 of the couch 18 can be folded up (arrow 28), and benches 29 and 30 can be placed in front of the folded up front portion 27 and the library unit 19, as illustrated. It will be recognized that either or both benches 29 and 30 may readily be replaced with other furniture elements, for example, a toy chest, not shown. These attachable units can be stored in the cubbyholes 15 of FIG. 1.

The furniture unit frame 11 can be provided with peg holes (not shown) that receive the pegs of the various units, as is well known in the art. Similarly, shelves 20 of the library unit 19 can be rearranged by varying the placement of their pegs in the peg holes provided in the columns 17 defining the library unit 19. Moreover, the platform 12 itself can be moved downwardly and secured or attached to legs 17 by suitable means such as, but not limited to, pegs, metal brackets, and the like.

Figure 3:
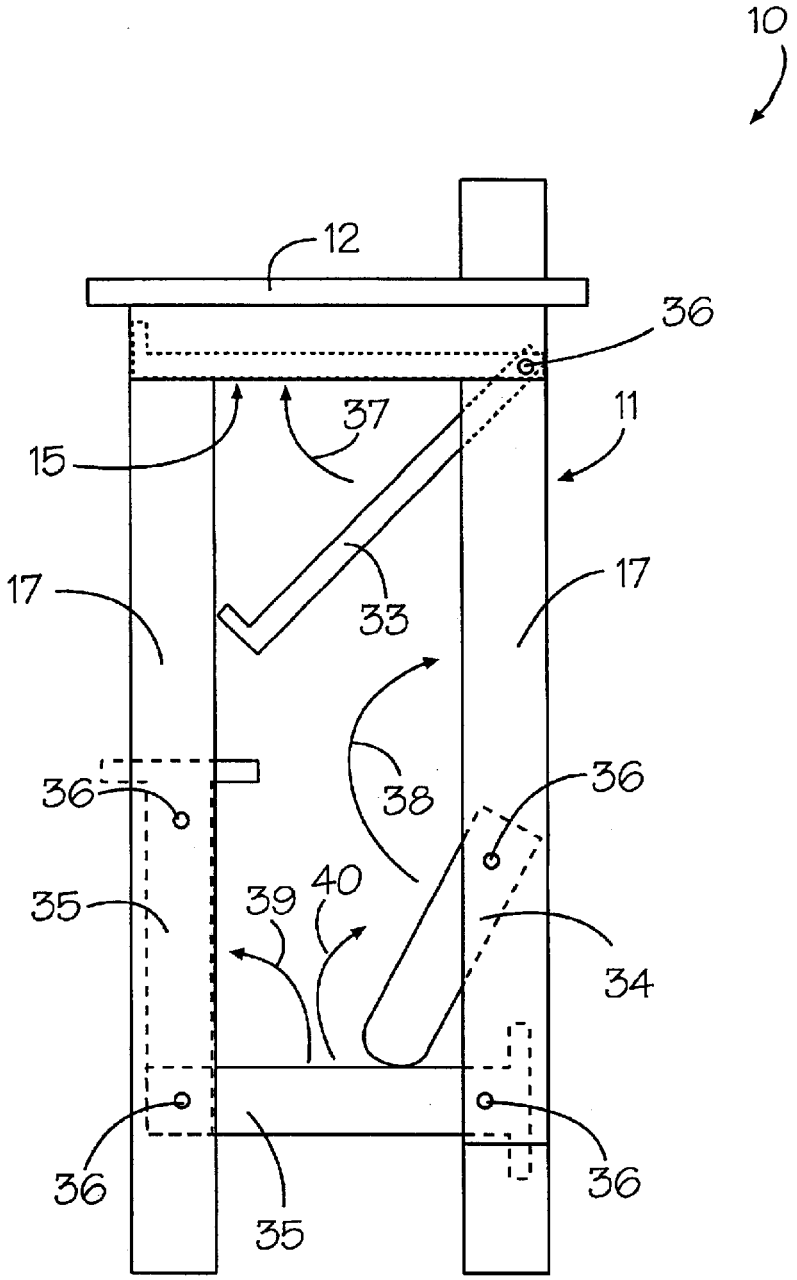
FIG. 3 shows a side view of the loft furniture unit depicting attached furniture elements that can be folded up, or folded down to change the living appearance of the unit.

Referring to FIG. 3, a side view of the furniture unit 10 is shown with various furniture elements 33, 34, and 35, respectively, that attach to columns 17 of the frame 11 by means of pegs and peg holes 36. Elements 33, 34, and 35 represent a wall unit, a fold-down seat, and a picture frame, respectively. These elements can be pivoted about their pegs and peg holes 36 to various different positions about the frame 11, as shown by respective arrows 37, 38, 39, and 40.

Figure 4:
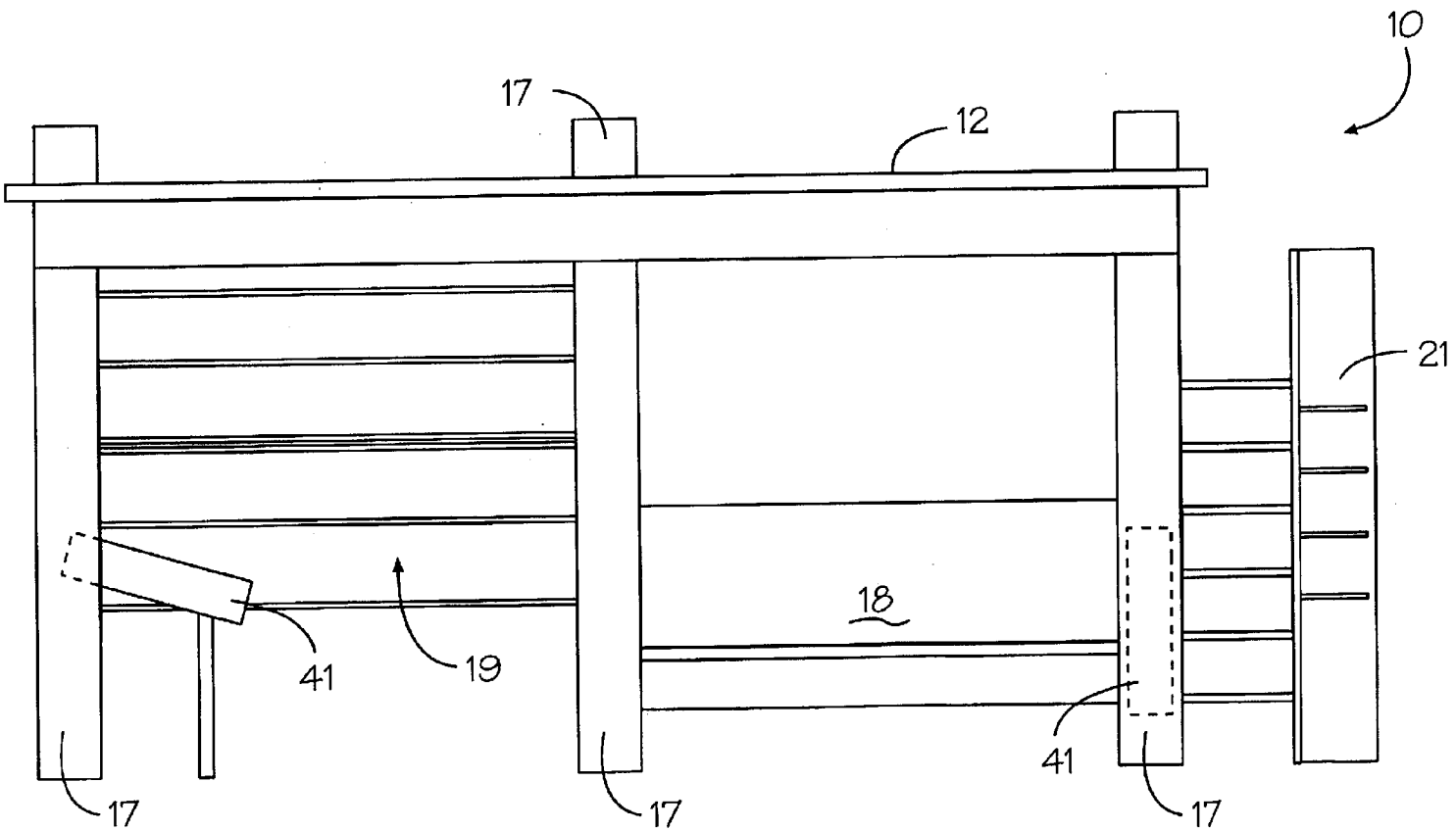
FIG. 4 illustrates a front view of an alternate embodiment of the loft furniture unit in a living room setting.

Referring to FIG. 4, a front view of an alternate embodiment of the furniture unit 10 of FIG. 1 is illustrated. In this view, the couch 18 has been placed on the right-hand side and the library has been placed on the left-hand side. A fold-up writing table 41 or desk (not shown) can be placed in front of the library unit 19.

Figure 5:
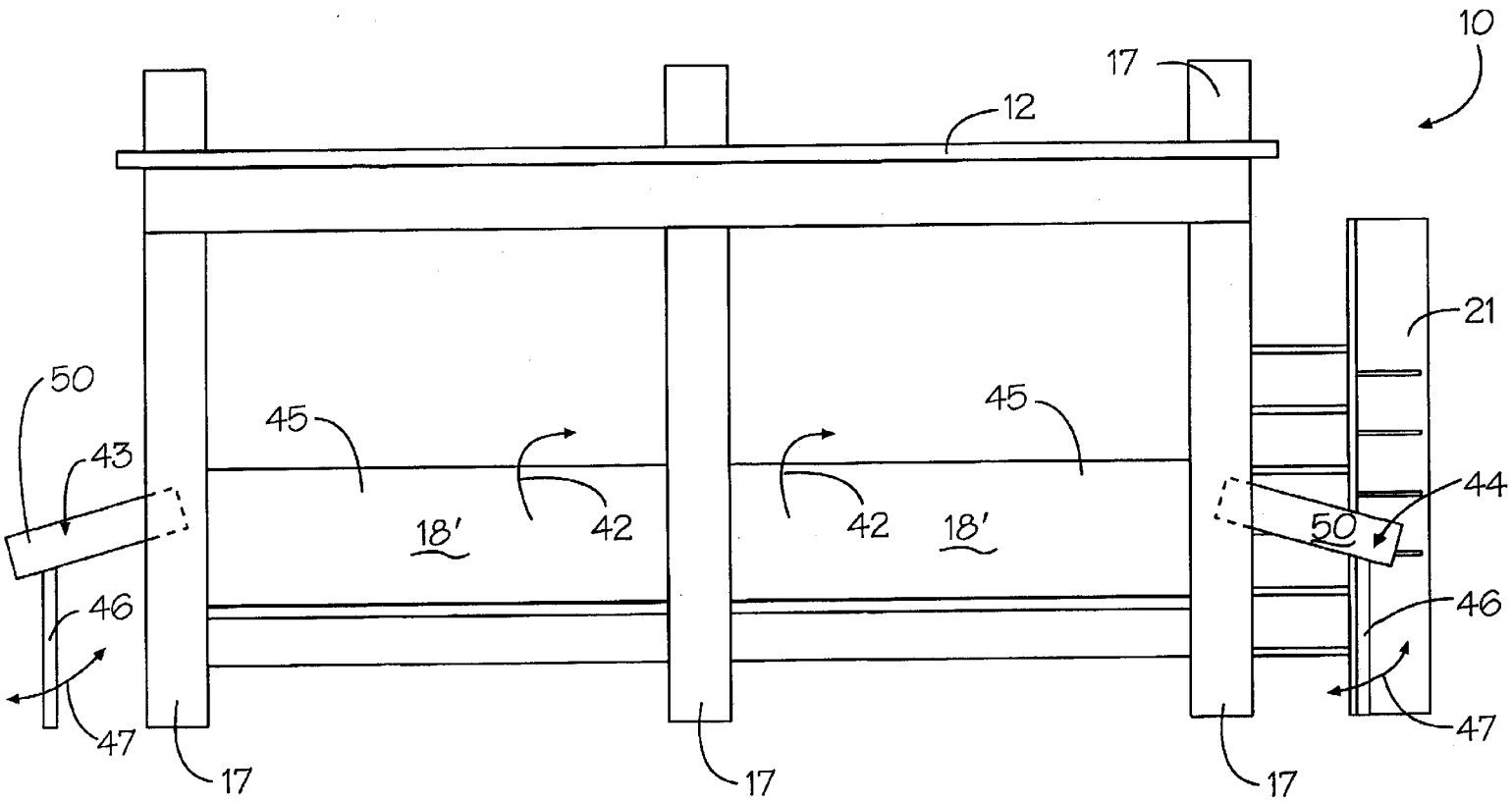
FIG. 5 depicts an alternate embodiment of the loft furniture unit illustrated in FIG. 4 depicted in a living room setting.

Referring to FIG. 5, a front view of another alternate embodiment of the furniture unit 10 of FIG. 1 is shown. The unit 10 now depicts a pair of wooden benches 18', the backs 45 of which can be folded down (arrows 42) to provide platforms for inflatable beds. This embodiment also depicts respective, foldaway, side attached desk units 43 and 44. The respective support legs 46 of the desk units 43, and 44 fold up (arrows 47) under the desk tables 50.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An easily reconfigurable furniture unit, comprising:

a) a single frame comprising a plurality of unitary, substantially vertical upright columns each having a proximal end for placement on a floor surface, and a distal end optionally adapted to receive a stringer for attachment to a structural support located above said single frame, and an upper horizontal planar surface disposed substantially perpendicular to each of said plurality of upright columns proximate said distal ends thereof, said single frame being adapted to receive and support at least two furniture elements disposed along a major axis thereof; and b) at least two furniture elements removably and reconfigurably affixed to said frame, at least one of said furniture elements comprising a folding component.

2. The easily reconfigurable furniture unit as recited in claim 1 wherein each of said at least two furniture elements comprises one from the group: couch, bed, desk, bench, table, shelf, lounge chair, cabinet, storage cubbyhole, chest, bench, beverage bar and ladder.

3. The easily reconfigurable furniture unit as recited in claim 2 wherein at least one of said furniture elements may be converted from a first one of said group of furniture elements to a second one of said group of furniture elements.

4. The easily reconfigurable furniture unit as recited in claim 3, further comprising:

c) means for reconfiguring comprising at least one of: means for rotating, means for sliding, and means for folding, said means for reconfiguring being operatively connected to at least one of: said frame, and at least one of said at least two furniture elements, said means for reconfiguring facilitating said conversion from a first one of said group of furniture elements to a second one of said group of furniture elements.

5. The easily reconfigurable furniture unit as recited in claim 4, wherein said means for folding comprises at least one of: means for folding up, and means for folding down.

6. The easily reconfigurable furniture unit as recited in claim 3, further comprising:

c) means for attaching associated with each of said furniture elements to facilitate said removable and reconfigurable attachment thereof.

7. The easily reconfigurable furniture unit as recited in claim 6, wherein said means for attaching comprises a plurality of peg holes disposed in at least one of said substantially vertical columns.

8. The easily reconfigurable furniture unit as recited in claim 3, further comprising:

c) means for connecting said frame to an element in an environment surrounding said reconfigurable furniture unit.

9. The easily reconfigurable furniture unit as recited in claim 8, wherein said element in an environment comprises at least one of: wall, ceiling, joist, and rafter.

10. The easily reconfigurable furniture unit as recited in claim 3, further comprising:

c) at least one furniture element reconfigurably attached to said frame outside a space having a perimeter defined by said plurality of unitary, substantially vertical columns.

11. The easily reconfigurable furniture unit as recited in claim 10, wherein said at least one furniture element outside said space is attached to said frame with at least one decorative rod.

12. The easily reconfigurable furniture unit as recited in claim 3, wherein said at least one of said furniture elements comprises a library unit comprising shelves, said shelves being disposed at a modifiable spacing apart from one another.

13. The easily reconfigurable furniture unit as recited in claim 3, wherein said platform is movable in a vertical direction with respect to said plurality of unitary, substantially vertical columns.

14. An easily reconfigurable furniture unit, comprising:

a) a single frame comprising at least one unitary, substantially vertical post having a proximal end for placement on a floor surface, and a distal end optionally adapted to receive a stringer for attachment to a structural support located above said single frame, and an upper horizontal planar surface disposed substantially perpendicular thereto proximate said distal end thereof; and b) at least two furniture elements removably and reconfigurably affixed to said frame, at least one of said at least two furniture elements comprising a folding component.

15. The easily reconfigurable furniture unit as recited in claim 14, further comprising means for attaching said distal end of said at least one post to an overhead support structure.

16. The easily reconfigurable furniture unit as recited in claim 14 wherein each of said at least two furniture elements comprises one from the group: couch, bed, desk, bench, table, shelf, lounge chair, cabinet, storage cubbyhole, chest, bench, beverage bar and ladder.

17. The easily reconfigurable furniture unit as recited in claim 16 wherein at least one of said furniture elements may be converted from a first one of said group of furniture elements to a second one of said group of furniture elements.

18. The easily reconfigurable furniture unit as recited in claim 17, further comprising:

c) means for reconfiguring comprising at least one of: means for rotating, means for sliding, and means for folding, said means for reconfiguring being operatively connected to at least one of: said frame, and at least one of said furniture elements, said means for reconfiguring facilitating said conversion from a first one of said group of furniture elements to a second one of said group of furniture elements.

19. The easily reconfigurable furniture unit as recited in claim 16, wherein at least one of said furniture elements comprises a library unit comprising shelves, said shelves being disposed at a modifiable spacing apart from one another.

20. The easily reconfigurable furniture unit as recited in claim 3, wherein said platform is movable in a vertical direction with respect to said at least one unitary, substantially vertical post.

* * * * *